US005345142A

United States Patent [19]

Chamberlain et al.

[11] Patent Number: 5,345,142

[45] Date of Patent: Sep. 6, 1994

[54] SINGLE-ENDED LOW-PRESSURE DISCHARGE LAMP

[75] Inventors: Leon F. Chamberlain, Mentor, Ohio; Miklos Hargitai, Budapest, Hungary; Ferenc Lantos, Budapest, Hungary; Jozsef Tokes, Budapest, Hungary; Istvan Wursching, Budapest, Hungary

[73] Assignees: General Electric Company, Schenectady, N.Y.; Tungsram Co., Ltd., Budapest, Hungary

[21] Appl. No.: 965,101

[22] Filed: Oct. 22, 1992

[51] Int. Cl.[5] ..... H01J 7/44

[52] U.S. Cl. ..... 315/58; 315/32; 313/634; 313/318; 439/615

[58] Field of Search ..... 315/32, 33, 58, 62, 315/71; 313/318, 493, 634; 439/613, 614, 615

[56] References Cited

U.S. PATENT DOCUMENTS 4,683,402 7/1987 Aubrey ..... 315/56
4,695,767 9/1987 Wittman ..... 315/58
5,164,635 11/1992 De Jong et al. ..... 315/58

FOREIGN PATENT DOCUMENTS 8705436 9/1987 World Int. Prop. O. ..... 315/58

*Primary Examiner*—James B. Mullins
*Assistant Examiner*—J. Dudek
*Attorney, Agent, or Firm*—George E. Hawranko; Stanley C. Corwin

[57] ABSTRACT

A single-ended low pressure discharge lamp having an Edison base includes at least one U-shaped fluorescent tube having electrode leads which are connected to a ballast arrangement disposed in a housing base. The housing base has an upper part on which the fluorescent tubes are mounted, a connecting part on which a threaded base is mounted and a supporting part formed between the upper part and the connecting part. Lead-in wires are connected from the ballast arrangement to the threaded base in a manner to facilitate automated assembly of the lamp. A first lead in wire connects to the central portion of the threaded base whereas a second lead-in wire connects to the sleeve portion after first passing through a guided opening formed in the housing base between the supporting part and the connecting part.

6 Claims, 2 Drawing Sheets

SINGLE-ENDED LOW-PRESSURE DISCHARGE LAMP

FIELD OF THE INVENTION

The invention is related to a single-ended low-pressure discharge lamp comprising at least one discharge tube filled with mercury and a noble gas and which is typically referred to as a compact fluorescent lamp. More particularly, this invention is related to a method and apparatus which allows for an easy manufacture or assembly of the lamp and lamp leads to the base.

BACKGROUND OF THE INVENTION

In the present time, compact fluorescent lamps are gaining more and more ground. Their popularity is explained by their significant energy saving and long lives. In order to increase the popularity of compact fluorescent lamps, a design has also been developed that connects the lamp to the lampholder by means of a so-called Edison screw base enabling an easy insertion in the place of conventional incandescent lamps. Previously, the assembling of compact fluorescent lamps with an Edison base was a very laborconsuming process since it required that the lead-in wires for supplying energy to the discharge tube extend from inside the housing and by means of soldering, be connected to the threaded base. Connecting one of the lead-in wires to the central body of the threaded cap could be carried out without any difficulty. It caused, however, a severe problem and also restricted the increase of productivity to fix the other lead-in wire to the sleeve or side portion of the threaded cap.

Several proposed designs aimed at the increase of productivity of compact fluorescent lamps, can lead to the reduction of specific costs which, in turn reduces lamp price and can further accelerate the spread of compact fluorescent lamps. For instance, in U.S. Pat. No. 4,695,767, a compact fluorescent lamp design also suitable for automated assembling is shown. Its principle is that the lead-in wire to be connected to the sleeve surface of the threaded base is directed across the inner hollow of the housing along the cylindrical ring supporting the threaded base to reach the lower edge of the cylindrical ring. Here, around the edge of the cylindrical ring, the lead-in wire is bent backwards along the outer mantle of the cylindrical ring towards the discharge tube. Then, the threaded base is pushed over the cylindrical ring of the housing prepared in the above way wherein the extended lead-in wire is fixed to the housing by way of a friction fit. During tightening, the lead-in wire that has been wedged in between the outer mantle of the cylindrical ring and the inner surface of the sleeve of the threaded base will also achieve electrical contact. This solution is, beyond doubt suitable for decreasing the labor required for assembling. However, it has the disadvantage that the long lead-in wire tends to get damaged or broken as early as during the operations performed prior to assembling with the threaded base.

Its further disadvantage is that it is not easy to handle the long lead-in wire and to direct it exactly and reliably, such handling can only be implemented with the aid of an auxiliary device that increases the expense for an automatic production equipment.

It is also a disadvantage of the above solution that, when connecting the lead-in wire to the threaded base during the operation of pushing on and tightening the threaded base over the cylindrical ring-shaped supporting portion of the housing, the lead-in wire may break or get damaged otherwise leading to the operational failure of the compact fluorescent lamp.

SUMMARY OF THE INVENTION

Our objective with the present invention was to eliminate the disadvantages of the known solutions and to develop a low-pressure discharge lamp design capable of being assembled in a reliable and defect-free manner both in the case of automated and manual assembling of either electronically ballasted or conventional compact fluorescent lamps.

The principle of our invention is the recognition that the above task can be performed by making a bore meeting particular requirements, in the mantle surface of the housing and by extending the current conductor to the sleeve of the threaded cap in a way different from those known so far.

In accordance with the objective set, the single-ended low-pressure discharge lamp according to the invention has at least one discharge tube filled with mercury and noble gas and is sealed in a gas-tight manner and provided with electrodes at its ends. The compact fluorescent lamp also includes a housing having a threaded base for connection to a lampholder, and a circuit component for operating the discharge tube which is placed in the inner space of the housing. The housing has an upper part, a connecting part and a hollow supporting part placed between the upper and the connecting parts and the ends of the discharge tube are placed side by side and are fixed in the upper part of the housing. The threaded base is mounted on the connecting part of the housing and is constructed of a central body and a sleeve electrically insulated from one another. At least one electrode lead connected with the electrodes of the discharge tube is connected to the central body of the threaded base through a circuit component, and at least a portion of a second electrode is directly or also through the circuit component, connected with the sleeve portion of the threaded base in an electrical current conductive manner by means of a lead-in wire arrangement. The housing is provided with a bore starting at the inner surface of the supporting part and extending to the junction line between the outer surface of the supporting part and the joining surface of the connecting part and has an outlet opening placed at least partly between the joining surface of the connecting part and the upper flange portion of the threaded base. A guiding surface is preferably placed adjacent to the inlet opening of the bore so as to facilitate automated insertion of the ballast into the housing.

The low-pressure discharge lamp according to the invention may include a further feature that the guiding surface of the supporting part of the housing is a preferably bow-shaped elongated bossage protruding from the inner surface of the supporting part and at least partly surrounding the inlet opening of the bore.

In a different embodiment, the guiding surface of the supporting part of the housing is formed as a countersunk opening which is open to the inner surface of the supporting part, the countersunk opening having a cross-section decreasing toward the inlet opening of the bore.

It is a preferred embodiment wherein the guiding surface is formed as a combination of the elongated bossage protruding from the inner surface of the supporting part of the housing and the introducing hollow countersunk into the inner surface.

In a preferred embodiment, the cylindrical bordering ring of the connecting part of the housing is provided with a radial slit such that the lead-in wire which connects with the sleeve portion of the threaded base is passed through the bore in the housing and then, between the joining surface of the connecting part and the sleeve of the threaded base, is bent back across the radial slit on the inner side of the connecting part, and the electrical contact between this lead-in wire and the sleeve portion of the threaded base is performed by clamping the sleeve onto the lead-in wire.

In still another embodiment, the lead-in wire is connected with the sleeve portion of the threaded base by soldering the lead-in wire to the upper flange portion of the sleeve.

The low-pressure discharge lamp according to the invention has, compared to the known constructions, several advantageous features. One advantage is that, due to the specific housing design, the length of the lead-in wire is substantially shorter. The lead-in wire is therefore easier to handle and its destruction or tearing-off prior to the final assembling is excluded. This results in a significant reduction of costs also since a substantial amount of lead-in wire can be saved and the rate of reject will also decrease.

The shorter lead-in wire together with the specific housing design has the combined beneficial effect of enabling the assembling to be performed on an automated machine line. Moreover, the automatic assembler can have a simpler construction resulting in a further cost reduction.

It can also be considered as an advantage that the lead-in wire traverses unguided only a short path prior to connecting with the sleeve of the threaded base. Due to damage that can take place in the case of current conductors passed over the outer surface of the cylindrical ring of the housing when the threaded base is being installed, such damage is largely avoided.

BRIEF DESCRIPTION OF THE DRAWINGS

In the following, the invention will be described in more details by way of examples illustrated by drawing in which.

DETAILED DESCRIPTION OF THE INVENTION

Figure 1:
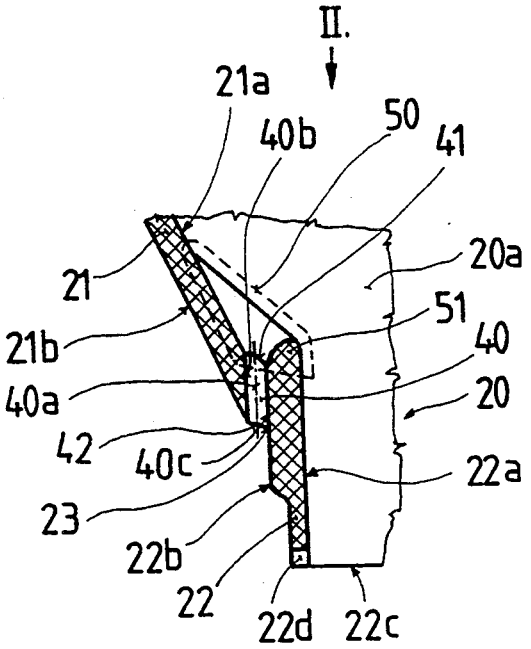
FIG. 1 is a detail of a longitudinal section of the housing constructed in accordance with the invention.
Figure 2:
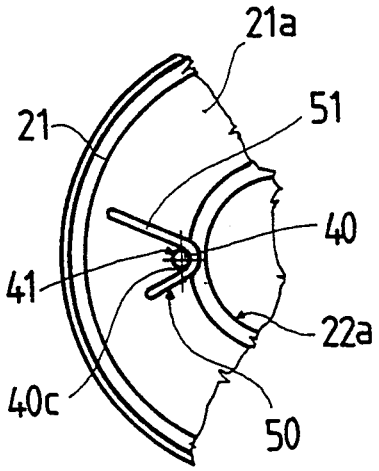
FIG. 2 is a detail of the elevational view of FIG. 1 viewed from direction II.

In FIGS. 1 and 2, details of the housing 20 forming a part of the invention are shown in longitudinal section and in top view, respectively. It is seen well that the bore 40 is located at the junction of the supporting part 21 and the connecting part 22 of the housing 20. The outlet opening 42 of the bore 40 runs out to the outer surface 21*b* of the supporting part 21 at the junction line 23 between the supporting part 21 and the connecting part 22. It is practical to form the bore 40 in the way that the axis 40*a* of the bore 40 is parallel to the direction of generatrix of the joining surface 22*b* of the connecting part 22 which is formed in the shape of a cylindrical ring. In this manner, the generatrix of the joining surface 22*b* of the connecting part 22 will form the continuation of the innermost generatrix 40*c* of the inner mantle surface 40*b* of the bore 40, which innermost generatrix 40*c* faces the inner space 20*a* of the housing 20.

It is also seen in FIG. 1 that the inner surface 21*a* of the supporting part 21 is provided with a guiding surface 50 at the inlet opening 41 of the bore 40.

In the case of the present embodiment, this guiding surface 50, as shown in FIG. 2, is made in the form of a bow-shaped elongated bossage 51 partly surrounding the inlet opening 41 and protruding from the inner surface 21*a* of the supporting part 21. This, of course, may also be a different profile protruding from the inner surface 21*a*.

The radial slit 22*d* formed in the bordering ring 22*c* and connecting the joining surface 22*b* with the inner side 22*a* of the connecting part 22 is found at the bottom edge of the connecting part 22. The radial sliot 22*d* serves to temporarily fix the lead-in wire in place until a threaded base is fixed in place. Of course other temporary holding arrangements can be used in place of the radial slit 22*d*.

Figure 3:
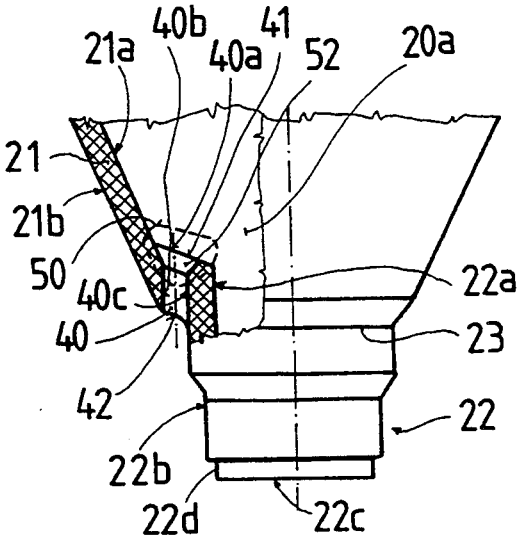
FIG. 3 is a side elevational view, partly in section, of an alternate embodiment of the housing.

FIG. 3 shows a housing 20 design partly differing from those described previously. The difference from the embodiment already described is found in the shape of the guiding surface 50. That is, here the guiding surface 50 is formed as countersunk opening 52 starting at the inner surface 21*a* of the supporting part 21 and ending at the inlet opening 41 of the bore 40. The countersunk opening 52 has a continuously decreasing cross-section and is bordered preferably by a truncated cone.

As seen from the comparison between FIGS. 1 and 3, there is no further difference between the shape and position of the two versions of the housing 20 and the bore 40.

Figure 4:
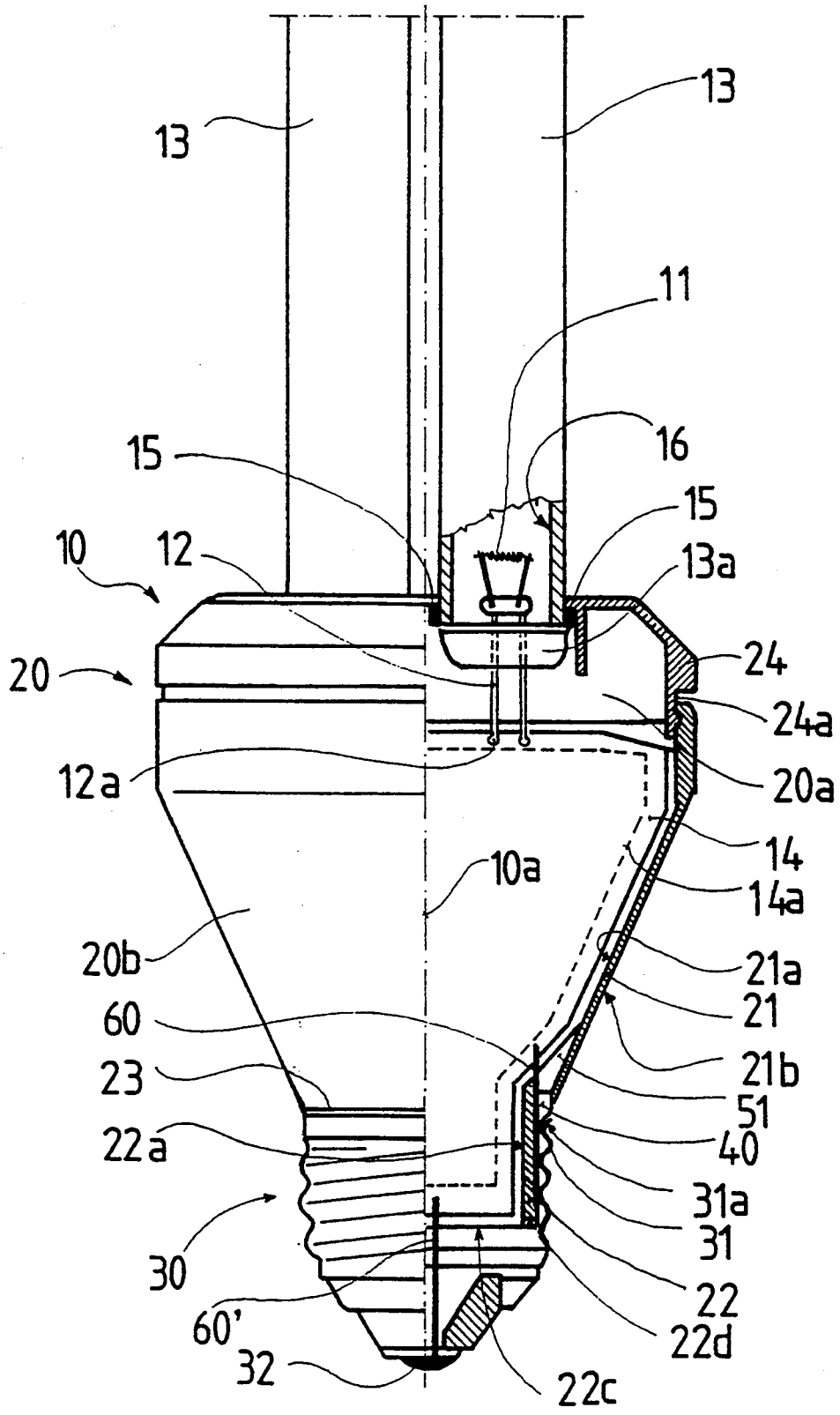
FIG. 4 is a side elevational view, partly in section, of the low-pressure discharge lamp according to the invention

In FIG. 4 a low-pressure discharge lamp 10 according to the invention is shown as a compact fluorescent lamp assembled from a multiple-bent discharge tube 13 shaped in the form of a U for instance and made from a transparent material, e.g. from glass. The discharge tube 13 can be composed of four parallel portions and of portions connecting these parallel portions to form essentially two U-shaped tube sections which are then connected to an electronic ballast as a circuit component 14.

Over the inner surface of discharge tube 13 a phosphor layer 16 is found for the conversion of the ultraviolet radiation generated due to the excitation of the mixture of mercury and the noble gas, into visible light.

The discharge tube 13 is sealed in a gas-tight manner by pinch-sealed portions 13*a* that also serve for fixing electrode leads 12 which support the electrodes 11. In FIG. 4, for the sake of simplicity, only one end of the discharge tube 13 provided with the electrodes 11 are shown in section, those described, however, also refer to the other end.

Each of the connection ends 12*a* of the electrode leads 12 which are more distant from the electrodes 11, are connected to a printed-circuit board 14*a* of the circuit component 14. The printed-circuit board 14*a* also holds electric components 14*b* symbolized by a dashed line. For a discussion of the operation of an electronic ballast circuit for a compact fluorescent lamp, reference is made to U.S. patent application Ser. No. 07/766,489 filed Sep. 26, 1991 by L. R. Nerone and assigned to General Electric Company.

From the printed-circuit board 14*a*, lead-in wires 60 and 60' start to connect the electrodes 11 of the discharge tube 13 with the threaded base 30 through the electrode leads 12 and the circuit component 14. The discharge tube 13 is fixed by the upper part 24 by means of a bonding material (e.g. cement). A connection collar portion 24*a* forms the continuation of the upper part 24 and serves for connection to the cylindrical ring-shaped connecting portion 20*b* of the housing 20.

Both the upper part 24 and the housing 20 are essentially circular in their cross-sectional dimension and are made by means of mould casting. These parts, however, may have different shapes or even may be made from different materials. The requirements they have to meet are to possess with satisfactory mechanical strength, insulation and heat-resistance properties as well as the ability to be spliced together.

It is also illustrated in FIG. 4 how lead-in wires 60 and 60' as well as the threaded base 30 are connected with each other. A first lead-in wire 60' starts from the printed-circuit board 14*a* and is soldered to the central body 32 of the threaded base 30.

A second lead-in wire 60 is preferably placed in the portion of the printed-circuit board 14*a* which portion will be located above the bore 40 as this enables the use the shortest length of lead-in wire 60.

The second lead-in wire 60 extends from the printed-circuit board 14*a* and across the bore 40 and along the joining surface 22*b* of the connecting part 22 in axial direction to the bordering ring 22*c* of the connecting part 22. After reaching the bordering ring 22*c*, the second lead-in wire 60 is bent, through the radial slit 22*d* on the inner side 22*a* of the connecting part 22 and is provisionally fixed in this way. This path of the second lead-in wire 60 is practical for manufacturing reasons, but is not essential in order to practice the present invention. From the point of view of the solution according to the invention, it is sufficient that the second lead-in wire 60 is introduced across the bore 40 and extends below the upper flange portion 31*a* of the threaded base 30 which is then pushed over the joining portion 22*b* of the connecting part 22.

Of course, in this latter case the radial slit 22*d* formed in the connecting part 22 can be omitted and yet still practice the present invention. Returning to the connection between the second lead-in wire 60 and the sleeve 31 of the threaded base 30, it is seen clearly in FIG. 4 that lead-in wire 60 rests between the joining surface 22*b* of the connecting part 22 and the sleeve 31 of the threaded base 30. The electrical contact is implemented by pressing the upper flange portion 31*a* of the sleeve 31 against the joining surface 22*b* of the connecting part 22. In the actual flange-pressing operation, the upper flange portion 31*a* is pushed against the second lead-in wire 60 and the permanent deformation resulting will establish the electrical contact.

The embodiment described above of the low-pressure discharge lamp 10 according to the invention can be quite readily assembled on an automated machine line. During assembling, the upper part 24 together with the discharge tube 13 provided with the circuit component 14 and inserted previously into the upper part 24, is pushed by the automated equipment into the inner space 20*a* of the housing 20. Since the lead-in wires 60 and 60' have the same direction as that of the longitudinal axis 10*a* of the low-pressure discharge lamp 10, the first lead-in wire 60' will simply pass by itself across the space surrounded by the bordering ring 22*c* of the connecting part 22.

The second lead-in wire 60 slides over that portion of the inner surface 21*a* of the supporting part 21 which portion is bordered by the bow-shaped elongated bossage 51. Guided by the bow-shaped elongated bossage 51, the second lead-in wire 60 will then pass through bore 40 to the joining surface 22*b* of the connecting part 22. Here, the second lead-in wire 60 will be positioned by an assembling operation in the way shown in FIG. 4. The threaded base 30 is pushed over the joining surface 22*b* of the connecting part 22 already supporting lead-in wire 60 and is fixed with the aid of the upper flange portion 31*a*.

Figure 5:
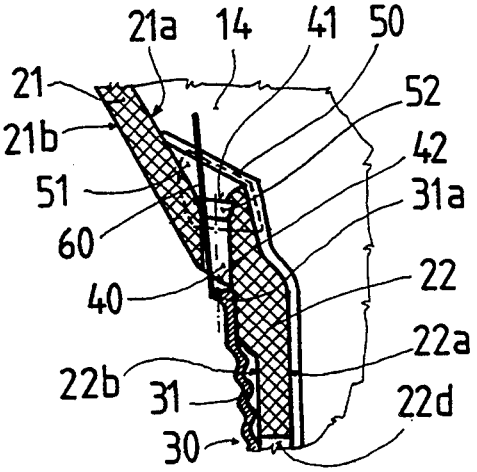
FIG. 5 is a detail shown in longitudinal section, of a second alternate embodiment of the housing.

In FIG. 5, a detail of a low-pressure discharge lamp 10 assembled differently from the above is shown. Here, the guiding surface 50 of the supporting part 21 is a combination consisting of a bow-shaped elongated bossage 51 protruding from the inner surface 21*a* of the supporting part 21 and a countersunk opening 52 formed in the material of the supporting part 21.

The second lead-in wire 60 protrudes from the supporting part 21 in that portion of the outlet opening 42 of the bore 40, which portion is not covered by the upper flange portion 31*a* of threaded base 30, while the protruding end of lead-in wire 60 is connected by means of soldering to the upper flange portion 31*a* of the sleeve 31. With this embodiment of the low-pressure discharge lamp 10, the assembling process may be the same as that described previously, but the manufacturing can also be organized so that the threaded base 30 is first pressed over the connecting part 22 of the housing 20 and the unit constructed in this way will accept the upper part 24 assembled with the circuit component 14 and the discharge tube 13. As the final operation of the process, the lead-in wires 60 and 60' are soldered. This embodiment of the low-pressure discharge lamp 10 according to the invention can be well used both for automated and conventional manufacture, whether fluorescent lamps with electronic ballasts or those assembled with conventional circuit components are involved.

When a low-pressure discharge lamp integral with a conventional circuitry is involved, the only difference from those described above is that at least electrode lead 12 is directly connected with the sleeve 31 of the threaded base 30.

What is claimed is:

1. A single-ended low-pressure discharge lamp comprising: at least one discharge tube sealed in a gas-tight manner and provided with electrodes at its ends; a housing provided with a threaded base suitable for connecting the lamp to a lampholder; ballast circuit means for operating the discharge tube and being disposed within said housing; said housing is provided with an upper part, a connecting part and a hollow supporting part, said supporting part being disposed between said upper and said connecting parts; said ends of said discharge tube are placed side by side and are fixed in said upper part of said housing; said threaded base is mounted on said connecting part of said housing and is constructed of a central portion and a sleeve portion electrically insulated from each other; at least one electrode lead connected with a corresponding at least one of said electrodes which is connected to said central portion of said threaded base through at least one circuit component associated with said ballast circuit means and through a first lead-in wire; a second lead-in wire is connected from said ballast circuit means to the sleeve of the threaded base in an electrical current conducting manner, and characterized in that said housing is provided with a bore starting at the inner surface of said hollow supporting part and extending to a junction line of the outer surface of said supporting part and a joining surface associated with said connecting part; said bore having an outlet opening placed at least partly between said joining surface of said connecting part and an upper flange portion of said sleeve portion of said threaded base; and, a guiding surface disposed on said inner surface of said supporting part adjacent to an inlet opening of said bore, said guiding surface being a substantially bow-shaped elongated bossage protruding from said inner surface of said supporting part and at least partly surrounding said inlet opening of said bore.

2. A low-pressure discharge lamp according to claim 1 characterized in that said guiding surface of said supporting part is formed as a countersunk opening which opens into said inner surface of said supporting part and has a cross-section decreasing towards said inlet opening of said bore.

3. A low-pressure discharge lamp according to claim 1 characterized in that said guiding surface is formed as a combination of an elongated bossage protruding from said inner surface of said supporting part and a countersunk opening which opens into said inner surface.

4. A low-pressure discharge lamp according to claim 1 characterized in that a bordering ring formed on said connecting part of said housing is provided with a radial slit so that said second lead-in wire can be connected to said sleeve portion of said threaded base.

5. A low pressure discharge lamp as set forth in claim 4 wherein said second lead-in wire is passed through said bore of said housing, between said joining surface of said connecting part and said sleeve portion of said threaded base, and is, having passed through said radial slit of said connecting part, bent backwards on an inner side of said connecting part, wherein the electrical contact between said second lead-in wire and said sleeve portion of said threaded base is implemented by clamping an upper flange portion of said sleeve portion onto said second lead-in wire.

6. A low-pressure discharge lamp according to claim 1 characterized in that said second lead-in wire to be connected to said sleeve portion of said threaded base is passed through said bore in said housing, and the electrical contact between the second lead-in wire and said sleeve portion is implemented by soldering said second lead-in wire to an upper flange portion of said sleeve portion of said threaded base.

* * * * *